US005805124A

United States Patent [19]

Kapoor et al.

[11] Patent Number: 5,805,124

[45] Date of Patent: Sep. 8, 1998

[54] SYMMETRIC ROW DRIVE FOR AN ELECTROLUMINESCENT DISPLAY

[75] Inventors: Mohan L. Kapoor, Orange; Thomas J. Rebeschi, North Haven; Peter O. Shanaghan, Stratford; Daniel J. Toffolo, Wilton, all of Conn.

[73] Assignee: Norhtrop Grumman Corporation, Los Angeles, Calif.

[21] Appl. No.: 626,898

[22] Filed: Apr. 4, 1996

[51] Int. Cl.[6] ..... G09G 3/30

[52] U.S. Cl. ..... 345/76; 345/79; 345/212

[58] Field of Search ..... 345/76, 77, 78, 345/79, 80, 100, 211, 212

[56] References Cited

U.S. PATENT DOCUMENTS 5,550,557 8/1996 Kapoor et al. ..... 345/76

*Primary Examiner*—Mark R. Powell
*Assistant Examiner*—Matthew Luu
*Attorney, Agent, or Firm*—Walter G. Sutcliff

[57] ABSTRACT

A method and apparatus for providing a driver circuit for an electroluminescent display panel comprising a row driver including positive row drive elements and negative row drive elements, a first power lead with a first predetermined voltage $V_{neg}$ connected in series through a first switch connection to a first node, the first node connected to a first current limiter to the negative row drive elements, a second current limiter operably connected between a first fixed potential to a second node, the second node connected to the positive row drive elements, a third current limiter connected between the negative row drive element and the second fixed potential, a second power lead with a second predetermined voltage $V_{pos}$ connected in parallel to the first node through a second switch connection and a power storage device connected between the first and second nodes, wherein the voltage across the positive and negative row drive elements is selectable, via predetermined operation of the first and second switch connections, between a) $V_{neg}$ and b) the difference between $V_{pos}$ and $V_{neg}$.

18 Claims, 3 Drawing Sheets

FIG. 1
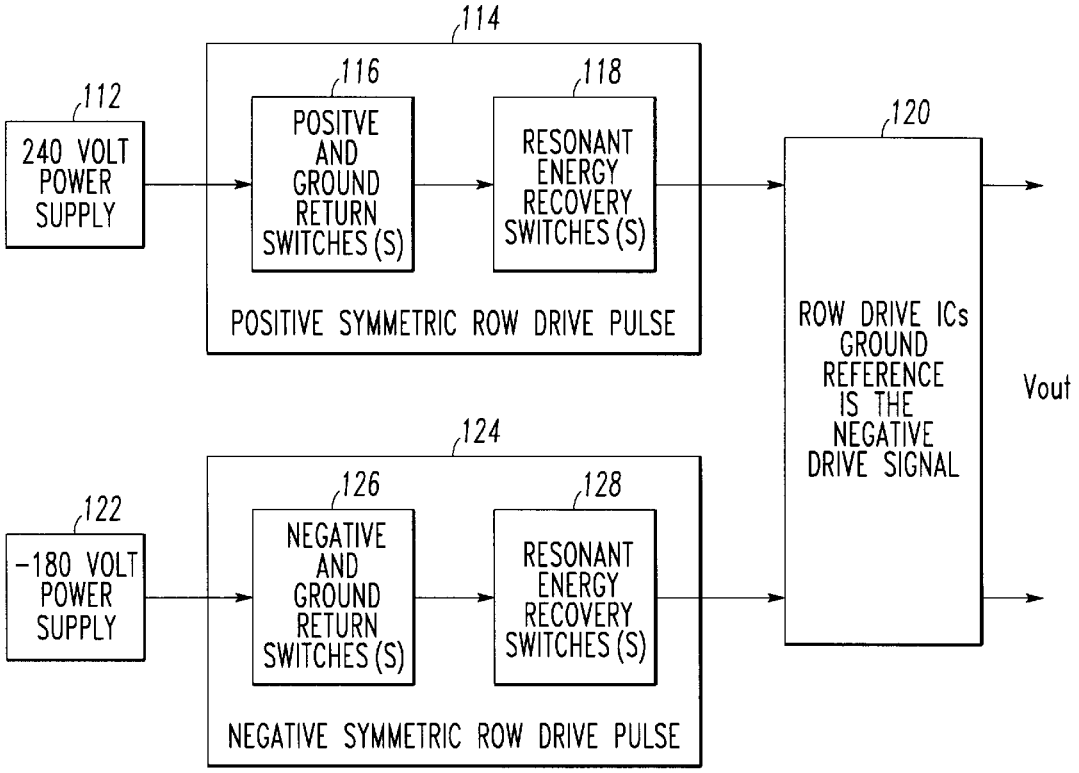
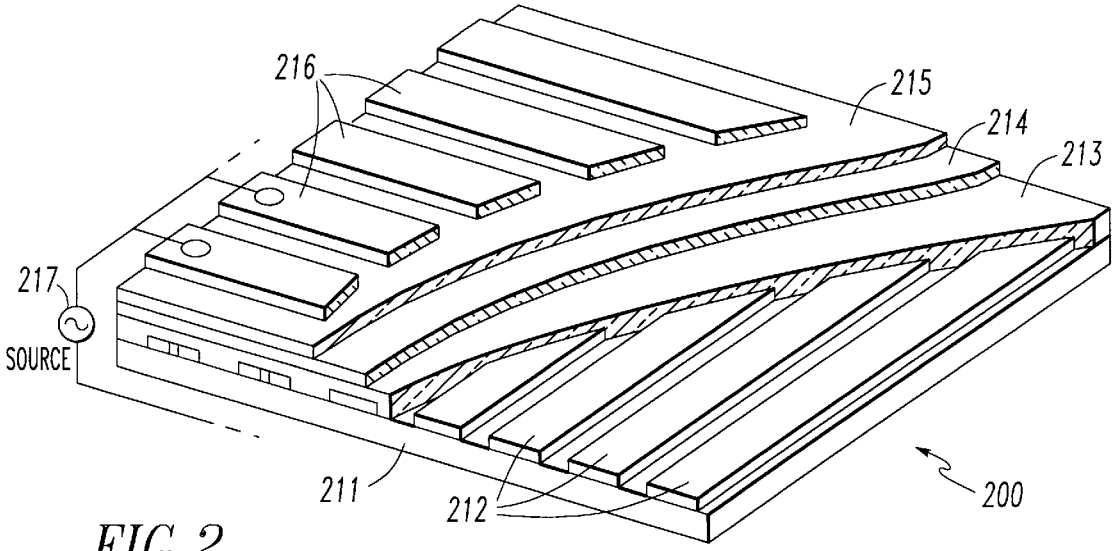
FIG. 2

FIG. 3
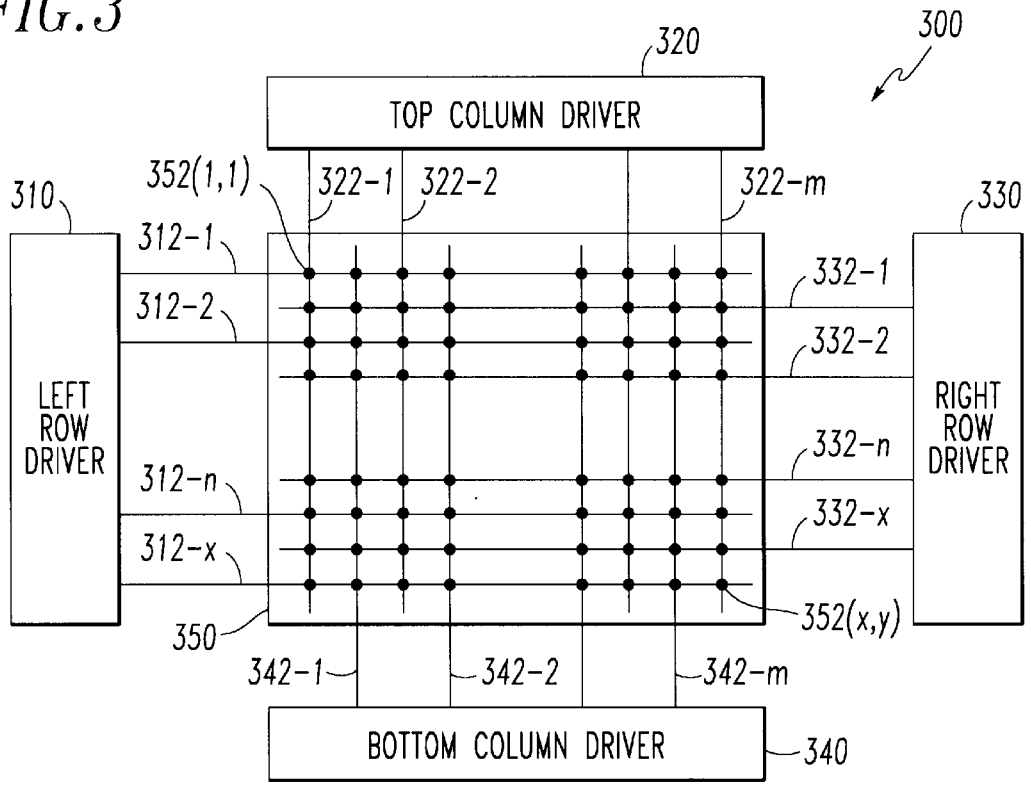
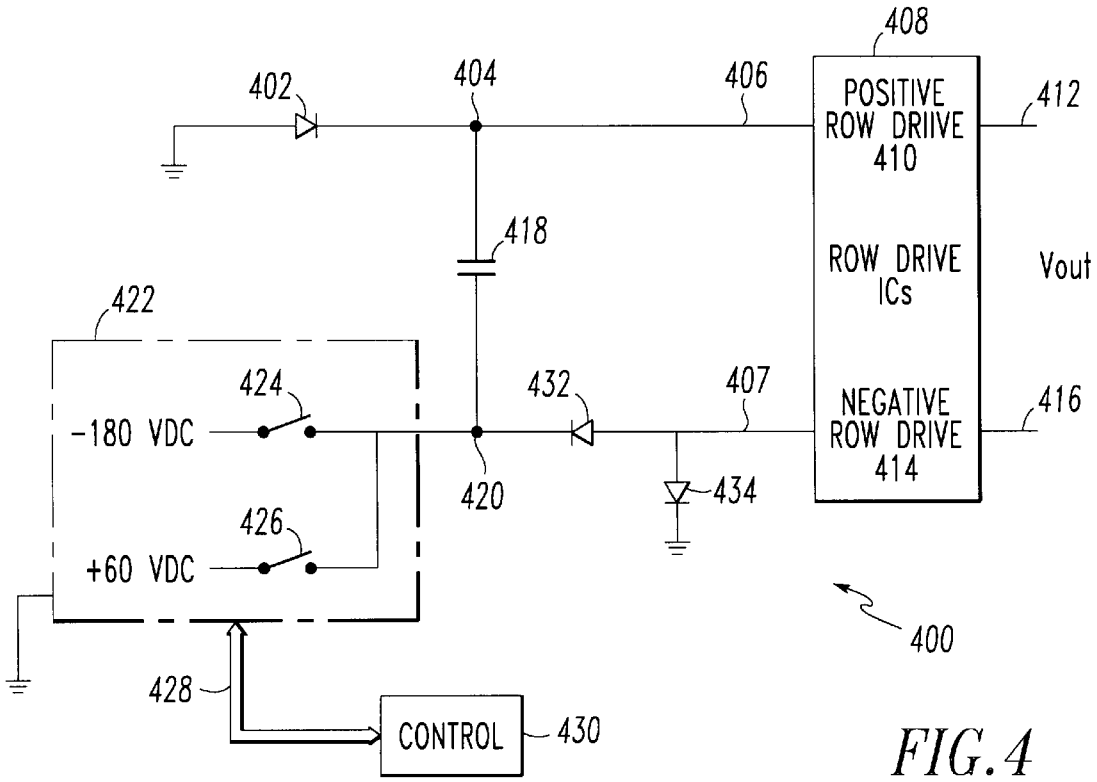
FIG. 4

FIG.5
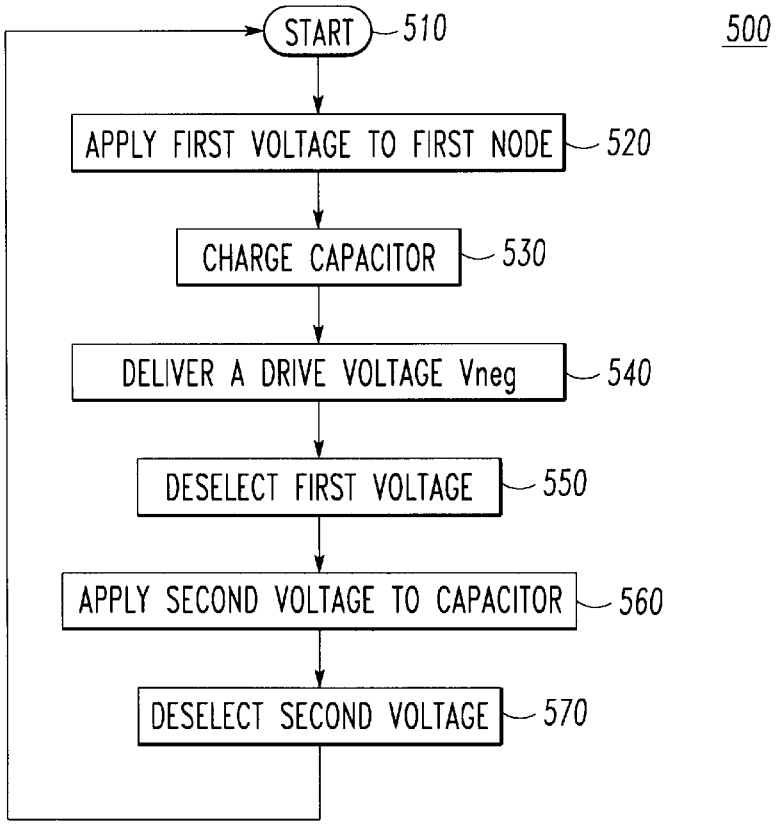
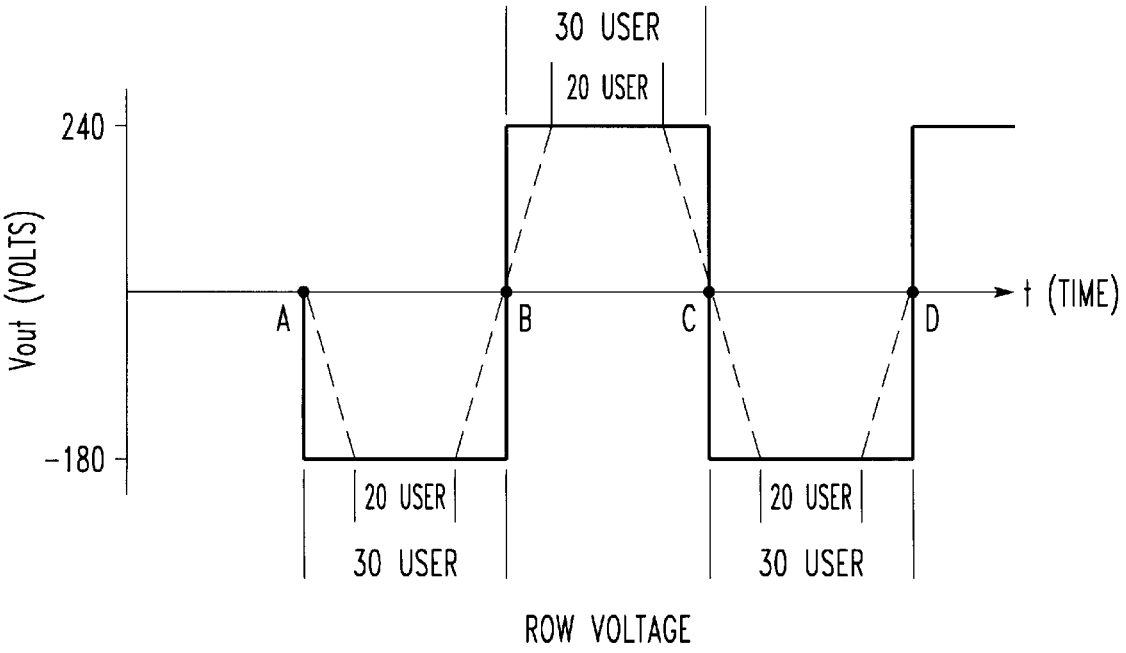
FIG.6

SYMMETRIC ROW DRIVE FOR AN ELECTROLUMINESCENT DISPLAY

BACKGROUND OF THE INVENTION

1. Field of the Invention

The present invention relates to apparatus and a method for thin-film electroluminescent panels and more particularly to related drive circuitry therefore. This application is related to application Attorney Docket No. N-1274, Ser. No. 08/626,895, filed concurrently and application Attorney Docket No. N-1275, Ser. No. 08/626,898, filed concurrently, whose specifications are hereby incorporated by reference.

2. Description of the Related Art

Electroluminescence (EL) is the emission of light from a phosphor due to the application of an electric field.

A typical thin-film electroluminescent (TFEL) display panel comprises a matrix-addressed panel of a thin-film phosphor in a thin-film dielectric sandwich. The thin-film phosphor emits light when a large enough electric field is applied across it. The electric field typically is provided by an electrode matrix that comprises a plurality of row electrodes and a plurality of orthogonally positioned column electrodes. The intersections of the row electrodes with the column electrodes define pixel cells. The pixel cells comprise the pixels of the TFEL display. When a voltage having a sufficient magnitude is applied between a row electrode and a column electrode, the phosphor of the pixel cell at the intersection will emit light. The magnitude of the voltage required to cause the phosphor to emit light is the threshold voltage.

In operation, a write voltage pulse is applied to the row electrodes, one row at a time (e.g., row one, followed by row two, and so forth). The write voltage pulse applied to the "addressed" row electrode (e.g., the first row) is below the threshold and is thus insufficient by itself to cause the phosphors of the first row to emit light. At the same time that the write voltage pulse is applied to the selected row electrode, a modulation voltage pulse is applied to each column electrode. If the difference between the modulation voltage pulse applied to the column and the write voltage pulse applied to the row exceeds the threshold voltage for the phosphor, then the pixel cell emits light. The intensity of the light may be controlled by varying the column voltage thus controlling the darkness of the resultant grey-scale pixel.

After the first row has been written, the write voltage pulse is applied to the next row (e.g., row two), and a modulation voltage pulse is applied to each column to cause the phosphors of selected pixel cells in the second row to emit light. The sequence is repeated for each row until an entire frame has been written.

Flat panel displays may be used for small, high resolution displays that reduce the size of the display but require the same amount of circuitry to drive the display. The packaging of the display drivers has been reduced with high density integrated circuits, but the corresponding interface circuits have yet to be adequately addressed.

A typical Thin Film Electroluminescent Display requires a symmetric row drive 100 as illustrated in FIG. 1 with both a 240 Volt power source 112 and a −180 Volt Power source 122. Symmetric drive systems are used to reduce the charge buildup across the electrodes which in turn reduces the latent image and pseudo persistence (ghost) problems of previous systems. The drive waveform $V_{out}$ from Row Drive IC 120 consists of a series of −180 Volt pulses and +240 Volt pulses.

Each of the row pulses are combined with an up to +60V modulation pulse from the column drive (not shown) as described above. Generation of each pulse historically has required its own separate bulky power supplies 112, 122. The output stray capacitance of each driver circuit 120 has been measured and is known to be approximately 2 pF per line. For a 480 row line panel as would be found in a VGA display, for example, the total stray capacitance is approximately 960 pF (not including any printed circuit board induced capacitance or wiring harness capacitance). This amount of capacitance significantly increases the power dissipation in drive circuits 120 as power is proportional to total capacitance $C_t$ and is given by the equation Power= $C_t \cdot V^2 \cdot f$, where V is the operating voltage and f is the frequency. To reduce power dissipation, resonant energy recovery switches 118, 128 are customarily utilized. Use of such recovery switches necessitates the use of ground return switches 116, 126 in series with an inductor (not shown). A total of 8 switches in the positive symmetric row drive pulse 114 and negative symmetric row drive pulse 124 units are required to drive a TFEL panel energy symmetric recovery drive system.

Such power supplies 112, 122 require extra printed wiring board space and require relatively heavy, bulky magnetic components that dissipate relatively high power.

A need exists for lightweight portable display devices and accompanying lightweight, low power and compact display drivers and power supplies for use in helmet mounted displays and other types of portable displays.

It is desirable to solve or ameliorate one or more of the above-described problems in the instant invention.

SUMMARY OF THE INVENTION

In the broadest sense, our invention rests upon our ability to provide both a −180 V and +240 V output to a row driver from a single −180 V and an already existing +60 V Supply, thus eliminating size, weight and expense of supplying a separate 240 V power supply. The +60 V power supply is already supplying the +60 V to the column driver circuitry.

According to a preferred embodiment of the invention, the invention is directed to a driver circuit for an electroluminescent display panel comprising a row driver including positive row drive elements and negative row drive elements, a first power lead with a first predetermined voltage $V_{neg}$ connected in series through a first switch connection to a first node, the first node connected to a first current limiter to the negative row drive elements, a second current limiter operably connected between a first fixed potential to a second node, the second node connected to the positive row drive elements, a third current limiter connected between the negative row drive element and the second fixed potential, a second power lead with a second predetermined voltage $V_{pos}$ connected in parallel to the first node through a second switch connection and a power storage device connected between the first and second nodes, wherein the voltage across the positive and negative row drive elements is selectable, via predetermined operation of the first and second switch connections, between a) $V_{neg}$ and b) the sum of $V_{pos}$ and $V_{neg}$.

It further includes a method of providing a row drive voltage for an electroluminescent display panel comprising the steps of a) selectively applying a first predetermined voltage $V_{neg}$ to a first node b) charging a storage device to the first predetermined voltage $V_{neg}$, the storage device having a first terminal connected to the first node, the first node operably connected through a first current limiter to negative row drive elements, the storage device with a second terminal connected to a) a first fixed potential through a second current limiter and b) positive row drive elements, the negative row drive elements operably connected to a second fixed potential through a third current limiter, c) delivering a predetermined voltage $V_{neg}$ across the positive and negative row drive elements.

Additionally provided is a method of providing a row drive voltage for an electroluminescent display panel further comprising the steps of d) deselecting the first predetermined voltage $V_{neg}$ to the first node, e) selectively applying a second predetermined voltage $V_{pos}$ to the first node to charge the storage device to a voltage $V_{sum}$ equal to the sum of $V_{pos}$ and the absolute value of $V_{neg}$, and f) applying voltage $V_{sum}$ across the positive and negative row drive elements.

Further features of the above-described intermediate frequency partitioning plan will become apparent from the detailed description hereinafter.

The foregoing features together with certain other features described hereinafter enable the overall system to have properties differing not just by a matter of degree from the any related art, but offering an order of magnitude more efficient use of already existing circuitry.

Additional features and advantages of the invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate preferred embodiments of the apparatus and method according to the invention and, together with the description, serve to explain the principles of the invention.

BRIEF DESCRIPTION OF THE DRAWINGS

FIG. 1 illustrates a conventional Row Drive Block Diagram.

FIG. 2 illustrates a Thin Film Electroluminescent Display Panel of the present invention.

FIG. 3 illustrates a Row-Column Driver configuration of the present invention.

FIG. 4 illustrates a Symmetric Row Driver of the present invention.

FIG. 5 illustrates a flowchart depiction of the method of the present invention.

FIG. 6 illustrates a waveform diagram of a voltage generated by a Row Driver of the present invention.

DETAILED DESCRIPTION

A typical TFEL structure is constructed from the front (viewing) side to the rear. The thin layers are sequentially deposited on a suitable substrate. Glass substrates are utilized to provide transparency. The transparent front electrodes are typically made from Indium Tin Oxide (ITO) and are deposited on the glass substrate by conventional means, typically by sputtering. The subsequent dielectric-phosphor-dielectric layers are then usually deposited by standard means, again typically by sputtering or evaporation. The phosphor layer is usually annealed after deposition to improve efficiency. The rear electrode may be then added. The finished TFEL laminate is encapsulated in order to protect it from external humidity. Epoxy laminated cover glass or silicon oil encapsulation are used. In that the initial substrate used for deposition is typically glass, the materials and deposition techniques employed in TFEL laminate construction cannot demand high temperature processing.

Referring now to FIG. 2, a thin film electroluminescent (TFEL) display panel 200 includes a glass substrate 211, a plurality of transparent electrodes 212, a first layer of insulating material 213, a layer of electroluminescent material 214, a second layer of insulating material 215 and a plurality of rear electrodes 216. The glass substrate 211 is preferably a borosilicate glass such as CORNING 7059 available from Corning Glassworks of Corning, N.Y. Each of the plurality of transparent electrodes 212 is preferably indium-tin-oxide (ITO) in a preferred embodiment of the present invention and each of the plurality of rear electrodes is Aluminum (Al). The insulating layers 213, 215 include a dielectric material and each layer acts as a capacitor to protect the electroluminescent material 214 from high direct electrical DC currents. The electroluminescent material is typically ZnS doped with Mn.

When a voltage source 217 applies a voltage signal across electrodes 212, 216 respectively, electrons flow and tunnel through layers 213–215 between electrodes 212, 216. These flowing electrons excite the Mn in the electroluminescent material such that the Mn emits photons which pass through both first insulating layer 213 and transparent electrodes 212 to form an image on glass substrate 211 when the magnitude of the voltage level across the electrodes is above a predetermined threshold voltage (e.g. 180 volts).

Referring now to FIG. 3, a TFEL display 300 includes a display panel 350, top and bottom column drivers 320, 340, and left and right row drivers 310, 330. Operably connected to top column driver 320 are top column electrodes 322-1, 322-2 . . . **322-*m* which extend almost to the bottom portion of display panel 350. In a similar fashion, operably connected to bottom column driver 340 are multiple bottom column electrodes 342-1, 342-2 . . . 342-*m* which extend almost to the top of display panel 350**.

Left row driver 310 is operably connected to multiple left row electrodes 312-1, 312-2 . . . **312-*n* which extend almost to the far right hand side of display panel 350. Likewise, right row driver 330 is operably connected to multiple right row electrodes 332-1, 332-2 . . . 332-*n* which extend almost to the far left hand side of display panel 350**. Connected to each of the row and column drivers is appropriate analog or digital information inputs (not shown) as the case may be.

The operation of the TFEL display is as follows. Left row driver 310 energizes left row electrode 312-1 with a predetermined write voltage, which in this embodiment is alternately either 240 or −180 V. It should be noted that the write voltage and modulation voltages are application specific and are intended to vary across a wide range of voltages according to the type of TFEL display contemplated. A modulation voltage of 0–60 V is applied to top column driver for placement on top column electrode 312-1. The intersection of the row and column electrodes is pixel 352(1,1). Pixel 352(1,1) is illuminated based on the difference between the row voltage of 240 V and the column modulation voltage of 0–60 V. If a column modulation voltage of 40 V is applied, for example, then the voltage difference of 240−40 =200 V is impressed on pixel 352(1,1) giving a corresponding illumination of the pixel. Modulation voltages are applied in a like manner across the intersection of left row electrode 312-1 and bottom column electrode 342-1, followed by top column electrode 322-2 in an alternating fashion on down the line until top column electrode **322-*m* illuminates pixel 352(1,*y*)** where y is the sum of the mth and nth column.

Successive rows represented by left row electrode **312-*x* and right row electrode 332-*x*, where x=1** to n, are addressed in similar fashion.

Symmetrically driven TFEL display panel 350 can be operated by applying the same polarity write voltage to each row electrode during a single frame and then reversing the polarity of the write voltage in the next frame. Alternatively, symmetrically driven display panel 350 can be operated by providing write voltages that alternate polarity on a row-by-row basis in one frame, and shift polarities of the applied write voltages in a succeeding frame.

Of course, when the row voltage alternates polarity as described above, since the brightness of the pixel depends from the voltage difference between the row and column electrodes, the column voltage must be inverted also. Specifically, the column voltage extends from 0–60 V when combined with a row voltage of −180 V. and the column voltage then extends from 60 to 0 V when combined with a voltage of +240 V in order to provide the same difference voltage which is applied to the individual pixel. For example, if the light emission from a pixel with a +240 V row voltage is desired to be the same as when the +40 V modulation voltage is used with a −180 V row voltage, as above, then the modulation voltage of 40 V must be inverted (that is, in this embodiment, revolved about an ordinate of 30 V, 30 being half way between 0 and 60) to 20 V in order to generate the same desired intensity. The difference between −180 and 40 is the same as the difference between 240 and 20—both are 220.

Referring now to FIG. 4, a Symmetric Row drive 400 of an embodiment of the present invention includes row drive 408 with input terminals 406, 407 and output terminals 412, 416 which deliver output $V_{out}$ to left and right row drivers 310, 330 (connections not shown). Node B 404 is connected to input terminal 406 of positive row drive 410, which is part of row drive 408. Node B 404 is connected to ground through diode 402 which prohibits current flow from node B to ground. Node B 404 is also connected to node A 420 through capacitor 418. Capacitor 418 may be any type of energy storage device(s), either in parallel as illustrated or reconfigured as a serial representation, say, for example as inductor(s).

The inductor configuration provides for energy storage in the form of current which allows the inductor to resonate into a capacitor to create the desired voltages. A feedback network could be provided to maintain the voltage accuracy. The capacitor implementation shown provides a direct translation of the required voltages for the negative and positive symmetric drive voltage transitions of the preferred implementation.

Node A 420 is also connected to external power module 422 which also include switches 424, 426 connected to −180 V and 60 V DC power supplies. The 60 v power supply is already used to supply the modulation voltage to the column drivers 320, 340 of FIG. 3. Switches 424, 426 could be replaced by a bipolar or MOSFET switching device with an isolated base or gate drive circuit that alternately connects either power supply to node A. An external control circuit 430 is connected to power module 422 to control the switching of the power supplies.

Node A is further connected to row drive ICs input 407 through a diode 432 which restricts current flow in the direction from node A to input 407. Input 407 is connected to ground through diode 434 which conducts current from input 407 to ground.

All voltages, capacitor values and type of electrical component may be varied or substituted for and still fall within the intended scope of this invention.

FIG. 5 illustrates a flowchart of the general operation of the symmetric row drive 400 of FIG. 4. Upon startup 510 of the process, node A 420 is disconnected from power module 422 as both switches 424, 426 are in an open state. At step 520 switch 424 is then closed, connecting node A to the −180 V power supply. Capacitor 418 is charged in step 530. A close inspection of FIG. 4 will reveal that the voltage measured across capacitor 418 from node B to node A is +180 V. This +180 V is also seen across input terminals 406, 407. In step 540, row drive ICs 408, through its negative row drive portion 414 generates a $V_{out}$ signal of −180V to the selected output 412, 416 for a predetermined scan time duration of A to B. Typically the scan time of a single row, which will vary upon the application, is 15 to 30 μsec. The row outputs are scanned from the top to the bottom sequentially. In step 550, Control 430 sends a deselect signal to power module 422 thereby disconnecting switch 424.

The Row drive ICs are standard parts used to address TFEL displays. Row driver vendors include Supertex (part number HV70, 72), Texas Instruments, Hitachi and SGS Thomson. In an embodiment, the row driver supplies the switching current to drive an individual row electrode, instead of the conventional bulk driver used to drive all the row drive ICs with the accompanying stray capacitance associated with every row electrode output stage. The use of the preferred embodiment significantly reduces power dissipation and simplifies drive circuit operation.

Another advantage of an embodiment of the present invention includes reduced packaging for mounting the chips on the panel directly. The existing ICs are designed for driving larger display panels with a much higher row line capacitance and have a much larger output stage structure than that required for the helmet mounted displays of the preferred embodiment. The displays of the preferred embodiment have a row capacitance of only the 10 pf range as compared to 4000 pf for larger panels.

In step 560, control 530 sends a control signal over bus 428 to power module 422 to close switch 426 which connects the +60 V power supply to node A. Capacitor 418 which remains charged at +180 V now has an additional +60 V added in series to create a voltage across Node B and the ground terminal of the +60V power supply of 240V. Note that diode 434 provides a current path which completes the circuit path from 240 V $V_{pos}$ input to ground. The 240 V is supplied to row drive ICs 408 across inputs 406, 407. Positive row drive 410 then selectively delivers a +240 V pulse to either the left or right row drivers 310, 330 respectively (connection not shown). Typical time periods used are such that voltage discharge from the capacitor is minimal during one or more scan times.

Control 430 then sends a deselect (open)signal to switch 426 in power module 422 in step 570. The process then repeats.

FIG. 6. illustrates the output $V_{out}$ of row drive ICs 408 as a function of time. $V_{out}$ is initially zero at time t=0 until time A because both switches 424, 426 are open. Upon closure of switch 424, Node 407 switches to −180 V (the input power supply voltage). The selected row output 412, 416 is then commanded to switch $V_{out}$ to −180V by turning the selected row driver output switch on. After a predetermined time interval has elapsed the row output switch is commanded off and the selected $V_{out}$ returns to an open condition The power module switch 424 is then opened and switch 426 is closed at time B. The voltage at Node 406 is switched from near ground to +240 V with the addition of the 60 V power supply as explained previously (60 V+180 V on capacitor 418). The selected row output 412, 416 is then commanded to switch the output to +240 V by turning the selected row output switch on. After an appropriate time interval (typically 15 to 30 μsec) has passed the row output switch is commanded off and the selected $V_{out}$ returns to an open condition. The power module switch 426 is then turned off and switch 424 is closed again. The voltage at node 407 is switched to −180 V and the cycle is repeated. During each positive and negative row cycle more than one row driver output switch $V_{out}$ may be selected on and then off allowing for several rows (up to n) to be addressed in the positive and negative direction before again reversing the power module 422 switches 424, 426. This process reduces the switching power losses by a factor of n.

The timing relationships of a preferred embodiment will now be discussed. The analog video input has a period of approximately 25 μsec, with a pixel clock sampling rate of about 25 MHz. A horizontal sync pulse with a period of 30 μsec with a 5 μsec sync time is supplied in a conventional fashion. The −180 V and 240 V Row Driver output pulses also have a period of 30 μsec period with an active time of 20 μsec.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A driver circuit for an electroluminescent display panel comprising:

a row driver including positive row drive elements and negative row drive elements;

a first power lead with a first predetermined voltage $V_{neg}$ connected in series through a first switch connection to a first node, said first node connected to a first current limiter to said negative row drive elements;

a second current limiter operably connected between a first fixed potential to a second node, said second node connected to said positive row drive elements;

a third current limiter connected between said negative row drive element and said second fixed potential;

a second power lead with a second predetermined voltage $V_{pos}$ connected in parallel to said first node through a second switch connection; and a power storage device connected between said first and second nodes;

wherein the voltage across said positive and negative row drive elements is selectable, via predetermined operation of said first and second switch connections, between a) $V_{neg}$ and b) the difference between $V_{pos}$ and $V_{neg}$.

2. A driver circuit as in claim 1 wherein said first current limiter is a diode.

3. A driver circuit as in claim 2 wherein said second current limiter is a diode.

4. A driver circuit as in claim 3 wherein said third current limiter is a diode.

5. A driver circuit as in claim 4 wherein $V_{neg}$ is approximately −180 V.

6. A driver circuit as in claim 5 wherein $V_{pos}$ is approximately +60 V.

7. A driver circuit as in claim 4 wherein said power storage device is a capacitor.

8. A driver circuit as in claim 4 wherein $V_{pos}$ is obtained from an external source.

9. A driver circuit as in claim 8 wherein said external source is a column driver.

10. A driver circuit as in claim 1 wherein said first and second switch connections are included in a single switch.

11. A driver circuit as in claim 6 wherein said first potential is operably connected to ground.

12. A driver circuit as in claim 9 wherein said second potential is operably connected to ground.

13. A method of providing a row drive voltage for an electroluminescent display panel comprising the steps of:

a) selectively applying a first predetermined voltage $V_{neg}$ to a first node;

b) charging a storage device to said first predetermined voltage $V_{neg}$; said storage device having a first terminal connected to said first node, said first node operably connected through a first current limiter to negative row drive elements, said storage device with a second terminal connected to a) a first fixed potential through a second current limiter and b) positive row drive elements, said negative row drive elements operably connected to a second fixed potential through a third current limiter;

c) delivering a predetermined voltage $V_{neg}$ across the positive and negative row drive elements.

14. A method of providing a row drive voltage for an electroluminescent display panel as in claim 13 further comprising the steps of:

d) deselecting said first predetermined voltage $V_{neg}$ to the first node;

e) selectively applying a second predetermined voltage $V_{pos}$ to the first node to charge the storage device to a voltage $V_{sum}$ equal to the sum of $V_{pos}$ and the absolute value of $V_{neg}$; and f) applying voltage $V_{sum}$ across the positive and negative row drive elements.

15. A method of providing a row drive voltage for an electroluminescent display panel as in claim 14 wherein step b) includes applying a voltage $V_{neg}$ of about −180 V.

16. A method of providing a row drive voltage for an electroluminescent display panel as in claim 15 wherein step e) includes applying a voltage $V_{pos}$ of about 240 V.

17. A method of providing a row drive voltage for an electroluminescent display panel as in claim 16 further including the step of operably connecting said first fixed potential to ground.

18. A method of providing a row drive voltage for an electroluminescent display panel as in claim 17 further including the step of operably connecting said second fixed potential to ground.

* * * * *